US007234952B2

(12) United States Patent
Sasaki et al.

(10) Patent No.: US 7,234,952 B2
(45) Date of Patent: Jun. 26, 2007

(54) LEVER TYPE CONNECTOR

(75) Inventors: Yasuhiro Sasaki, Shizuoka-ken (JP); Shoji Yamamoto, Shizuoka-ken (JP); Takahiro Yoneda, Kanagawa-ken (JP); Ryo Sawada, Kanagawa-ken (JP); Ken Yoshimura, Kanagawa-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/581,465

(22) Filed: Oct. 17, 2006

(65) Prior Publication Data

US 2007/0087599 A1 Apr. 19, 2007

(30) Foreign Application Priority Data

Oct. 18, 2005 (JP) ..... 2005-303518

(51) Int. Cl.
*H01R 13/62* (2006.01)

(52) U.S. Cl. ..... 439/157

(58) Field of Classification Search ..... 439/157, 439/466, 372, 468
See application file for complete search history.

(56) References Cited

U.S. PATENT DOCUMENTS 6,345,995 B1 * 2/2002 Bigotto et al. ..... 439/157
6,679,711 B2 * 1/2004 Takahashi ..... 439/157
6,832,922 B2 * 12/2004 Kozono et al. ..... 439/135
7,004,769 B1 * 2/2006 Putnam et al. ..... 439/157
7,025,610 B2 * 4/2006 Demuth ..... 439/157
7,052,293 B2 * 5/2006 Koshy et al. ..... 439/157
7,137,835 B2 * 11/2006 Shiga ..... 439/157
7,150,640 B2 * 12/2006 Fukui et al. ..... 439/157
7,175,451 B2 * 2/2007 Shuey ..... 439/157
7,179,132 B2 * 2/2007 Flowers ..... 439/686
2003/0040535 A1 * 2/2003 Aspnes et al. ..... 514/381
2004/0192090 A1 * 9/2004 Flowers et al. ..... 439/157

FOREIGN PATENT DOCUMENTS

JP 2003-086301 3/2003

* cited by examiner

*Primary Examiner*—Michael C. Zarroli
*Assistant Examiner*—Phuongchi Nguyen
(74) *Attorney, Agent, or Firm*—Finnegan, Henderson, Farabow, Garrett & Dunner, L.L.P.

(57) ABSTRACT

A lever type connector of the present invention includes a connector housing, a cover, a lever rotatably mounted on the connector housing, and a snap tab mounted on the cover. During rotation of the lever from an unlocking position to a locking position, the snap tab is pressed by the lever and bent, and if the lever reaches the locking position, the snap tab is brought back to lock the lever. The maximum bent inward angle of the snap tab is set to be smaller than the outward inclination angle of the snap tab without being bent. It is possible to prevent contact between the snap tab and the electric wires. The electric wires are prevented from being damaged, and the operation failure of the snap tab is also avoided.

5 Claims, 7 Drawing Sheets

LEVER TYPE CONNECTOR

BACKGROUND OF THE INVENTION

1. Field of the Invention

The present invention relates to a lever type connector to which a partner connector is fitted by rotating a lever.

2. Related Background Art

The lever type connector pulls in the partner connector from a half-fitted position to a full-fitted position of a connector housing by rotation of a lever, so that the reliability of a fitting operation is secured (e.g., Japanese Patent Application Laid-open No. 2003-86301). FIGS. 1 and 2 show a conventional example of such a lever type connector.

As shown in FIGS. 1 and 2, a lever type connector 100 includes a connector housing 101 to which a terminal (not shown) having electric wires W is connected, a cover 102 mounted on the connector housing 101, and a lever 103 mounted on the connector housing 101 to be rotatable around rotation pins 101*a*. The cover 102 accommodates the electric wires W and leads out the electric wires W as a batch of the electric wires so that directions of the electric wires W led out from cavities 101*b* of the connector housing 101 are converged in a direction of 0 to 90 degrees with respect to a leading out direction.

The connector housing 101 includes the cavities 101*b*, and terminals having the electric wires W are attached to the cavities 101*b*. The cover 102 is mounted on the connector housing 101 to cover the outer sides of the cavities 101*b*. The cover 102 is provided with a snap tab 104. A distal end of the snap tab 104 is formed as a barbed detent and it projects from an outer surface of the cover 102. When this projecting portion is pushed, the snap tab 104 is bent inward of the cover 102. The lever 103 is mounted on the connector housing 101 such that the lever 103 can rotate between an unlocking position (a position shown in FIG. 1) and a locking position (a position shown in FIG. 2). A pair of cam groove 103*a* is formed in the lever 103.

A fitting operation of a partner connector (not shown) will be explained. First, an operator inserts the partner connector into the connector housing 101 from the direction of the arrow A, engages cam pins (not shown) of the partner connector with the cam grooves 103*a* of the lever 103, and sets the partner connector in a half-fitted position. If the operator rotates the lever 103 in the unlocking position in the direction of the arrow B, the cam pins receive pressing forces from the cam grooves 103*a* respectively by the rotation of the lever 103, and the partner connector is gradually displaced toward a full-fitted position of the connector housing 101. If a rotated position of the lever 103 reaches a portion just before the locking position, the lever 103 presses the snap tab 104 of the cover 102, and the snap tab 104 is bent inward of the cover 102 (in the direction F in FIG. 2). With this, the lever 103 can further rotate. If the lever 103 is rotated to the locking position, the partner connector is pulled in to the full-fitted position. If the lever 103 reaches the locking position, the snap tab 104 is returned toward outside of the cover 102 (an opposite direction to the direction F in FIG. 2) to lock the lever 103.

A releasing operation will be explained. If the operator pushes down the snap tab 104 to rotate the lever 103 in the locking position to the unlocking position, the partner connector is separated from the full-fitted position to the half-fitted position. If the operator separates the partner connector in the half-fitted position from the connector housing 101, the releasing operation is completed.

SUMMARY OF THE INVENTION

According to the conventional lever type connector 100, the snap tab 104 that is bent inward of the cover 102 (in the direction F in FIG. 2) presses the batch of the electric wires when the lever 103 rotates to the locking position. As a result, the snap tab 104 and the electric wires W may contact with each other. If the snap tab 104 and the electric wires W contact with each other, excessive pressure may act on surfaces of the electric wires and a sheath (insulator) may be damaged. Further, the operator may erroneously recognize the contact between the snap tab 104 and the electric wire W as a full-fitted state.

The present invention has been achieved to solve the above problem, and it is an object of the invention to provide a lever type connector capable of preventing the snap tab and the electric wire from contacting with each other, preventing the electric wire from being damaged, and avoiding operation failure of the snap tab.

The lever type connector according to the present invention comprises a connector housing to which a terminal having electric wires is attached, a cover mounted on the connector housing, a lever mounted on the connector housing to be rotatable between an unlocking position and a locking position, and a snap tab provided on the cover. To converge directions of the electric wires led out from cavities of the connector housing into a direction of 0 to 90 degrees with respect to the leading direction thereof, the cover accommodates the electric wires therein and leads out the electric wires as a batch of electric wires. If the lever is rotated from the unlocking position to the locking position in a state where a partner connector is half-fitted into the connector housing, the lever forcibly displaces the partner connector from a half-fitted position to a full-fitted position. The snap tab is pressed by the lever and bent inward of the cover during rotation of the lever from the unlocking position to the locking position so that the lever can rotate, and if the lever reaches the locking position, the snap tab returns and locks the lever. The maximum bent angle of the snap tab bent inward of the cover is set to be smaller than an inclination angle of the snap tab outward of the cover when the snap tab is not bent.

According to the present invention, the maximum bent angle of the snap tab bent inward of the cover is set to be smaller than an inclination angle outward of the cover when the snap tab is not bent. Thus, a projecting stroke of the snap tab can be made smaller than a stroke for bending the snap tab. When the snap tab is to be bent, a bending projection amount of the snap tab inward of the cover can be suppressed, and it is possible to prevent the snap tab and the electric wires from contacting with each other. As a result, even when an electric wire filling ratio inward of the cover in the vicinity of the snap tab is high, it is possible to prevent the locking portion from coming into contact with the electric wire, to prevent the electric wire from being damaged by the pressing, and to avoid the operation failure of the snap tab.

It is preferable that a reinforcing rib that prevents the electric wires from entering a bending region of the snap tab projects from an inner surface of the cover in the vicinity of the snap tab. Consequently, since the electric wires in the cover are accommodated so that the electric wires do not enter the bending range of the snap tab, it is possible to reliably prevent the snap tab and the electric wires from contacting with each other.

It is preferable that the reinforcing rib surrounds the entire periphery of the snap tab. Consequently, since the entire outer periphery of the locking portion is protected, it is possible to substantially completely prevent the electric wires and the snap tab from contacting with each other. Further, since the fixed side thickness of the snap tab can be adjusted in a range from the thickness of the cover to the height of the reinforcing rib, the flexibility for forming the snap tab is enhanced. When a slit(s) is formed in the cover to form the snap tab integrally, it is possible to prevent a crack from being generated toward the slit periphery by the reinforcing rib. If the snap tab is formed by the slit(s), a surface of the cover is opened and the strength of the cover is lowered, but the deterioration of the strength can be suppressed by the reinforcing rib.

The lever type connector of the present invention comprises a connector housing to which a terminal having electric wires is attached, a cover mounted on the connector housing, a lever mounted on the connector housing to be rotatable between an unlocking position and a locking position, and a snap tab provided on the cover. To converge directions of the electric wires led out from cavities of the connector housing into a direction of 0 to 90 degrees with respect to the leading direction thereof, the cover accommodates the electric wires therein and leads out the electric wires as a batch of electric wires. If the lever is rotated from the unlocking position to the locking position in a state where a partner connector is half-fitted into the connector housing, the lever forcibly displaces the partner connector from a half-fitted position to a full-fitted position. The snap tab is pressed by the lever and bent inward of the cover during rotation of the lever from the unlocking position to the locking position so that the lever can rotate, and if the lever reaches the locking position, the snap tab returns and locks the lever. A reinforcing rib that prevents the electric wires from entering a bending region of the snap tab projects from an inner surface of the cover near the snap tab. Another reinforcing rib projects from the inner surface of the cover at a position other than the periphery of the snap tab.

According to the present invention, the strength of the cover is enhanced by the reinforcing rib. Consequently, it is possible to prevent the cover from deforming when the snap tab is bent, and the thickness of the side surface of the cover can be reduced. It is possible to assist the convergence of the electric wires by the other reinforcing rib.

It is preferable that each reinforcing rib is provided in a form of a lattice. Consequently, since the reinforcing rib in the lateral direction and the reinforcing rib in the vertical direction mutually prevent deforming, rigidity against twisting of the cover is enhanced.

It is preferable that the reinforcing rib other than the other reinforcing rib surrounds the entire periphery of the snap tab. Consequently, since the entire outer periphery of the locking portion can be protected, it is possible to substantially completely prevent the electric wires and the snap tab from contacting with each other. Further, since the fixed side thickness of the snap tab can be adjusted in a range from the thickness of the cover to the height of the reinforcing rib, the flexibility for forming the snap tab is enhanced. When a slit(s) is formed in the cover to form the snap tab integrally, it is possible to prevent a crack from being generated toward the slit periphery by the reinforcing rib. If the snap tab is formed by the slit(s), a surface of the cover is opened and the strength of the cover is lowered, but the deterioration of the strength can be suppressed by the reinforcing rib.

DESCRIPTION OF THE PREFFERED EMBODIMENT

Figure 1:
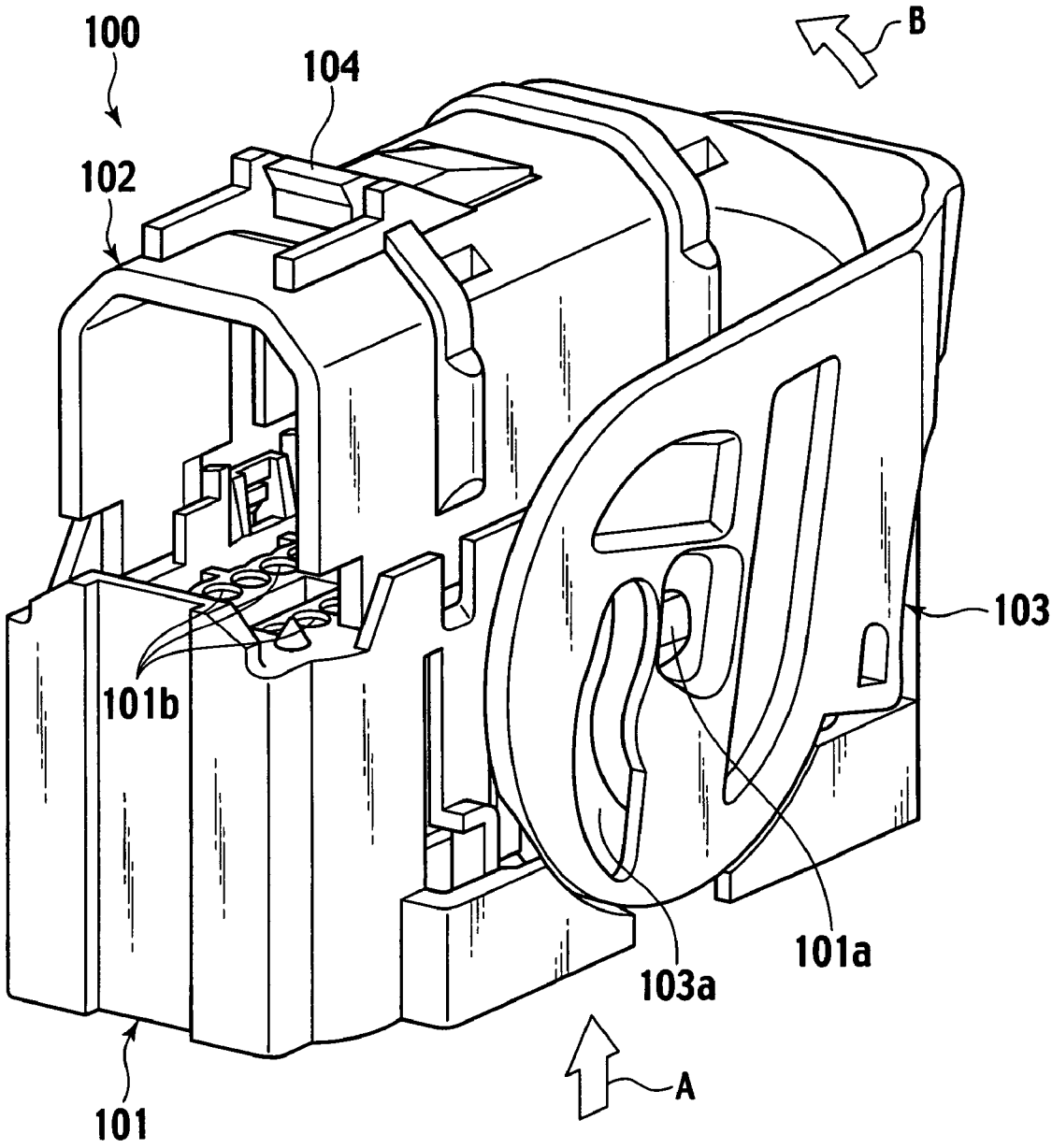
FIG. 1 PRIOR ART
FIG. 1 is a perspective view of a conventional lever type connector.
Figure 2:
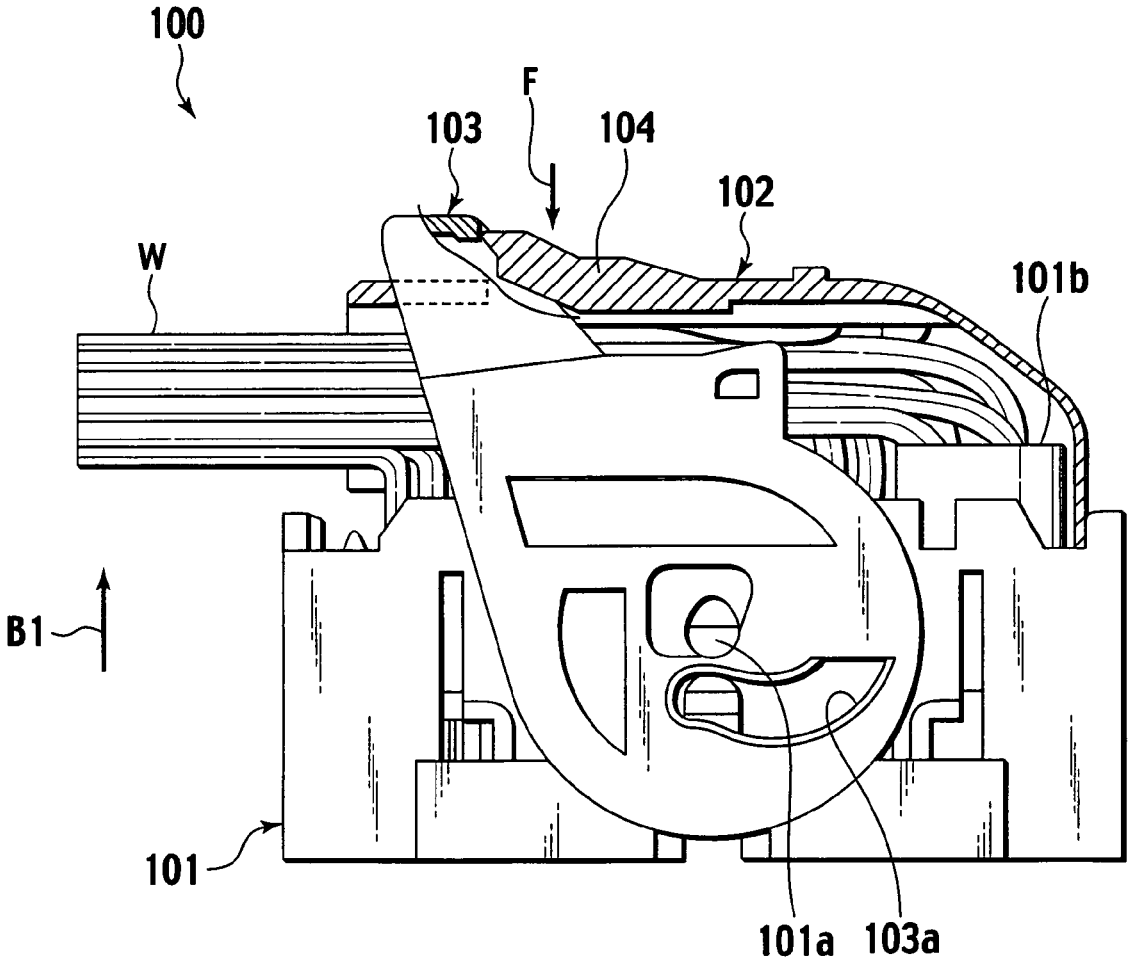
FIG. 2 PRIOR ART
FIG. 2 is a side view of the conventional lever type connector.
Figure 3:
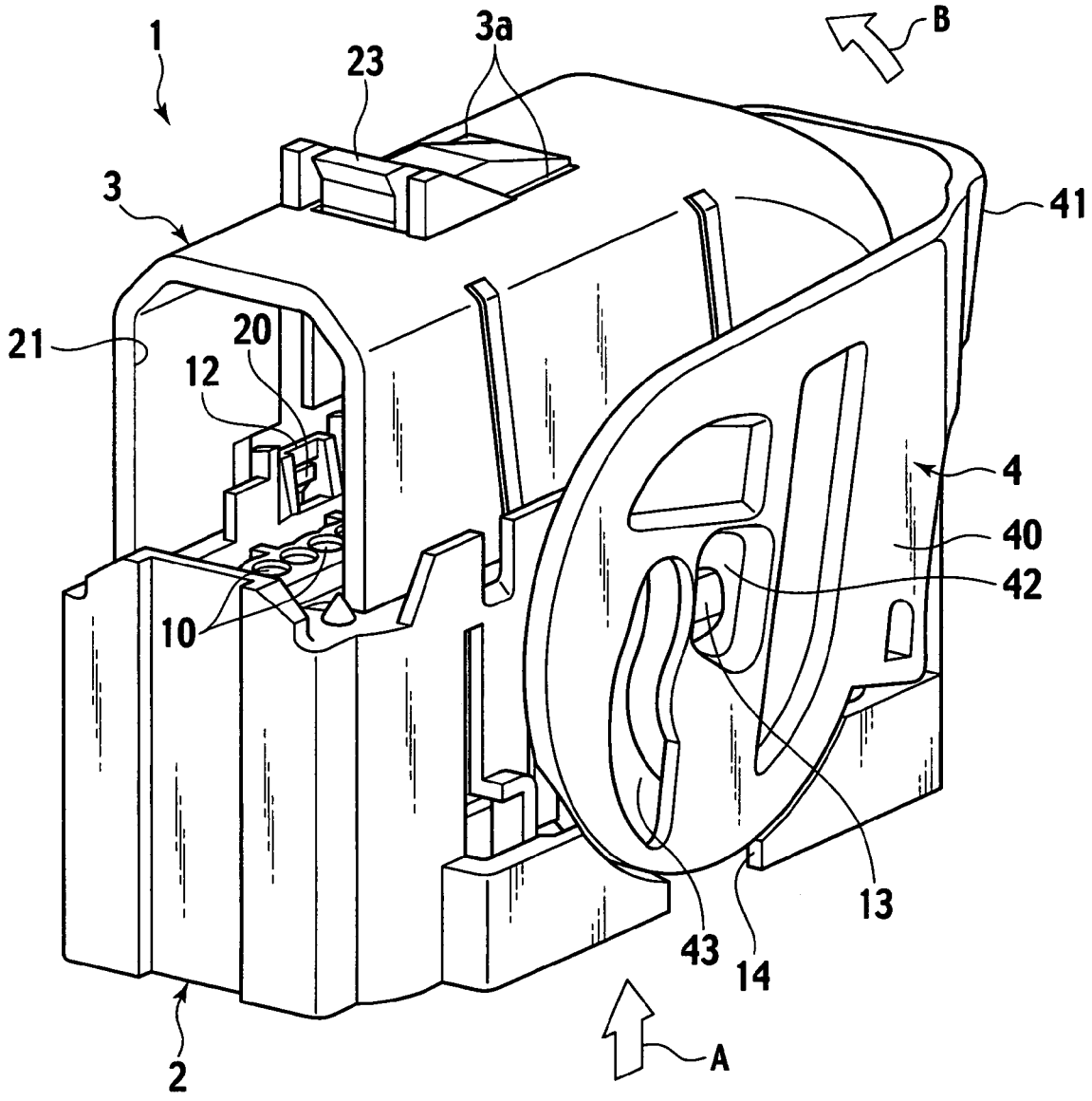
FIG. 3 is a perspective view of a lever type connector according to an embodiment of the present invention.
Figure 4:
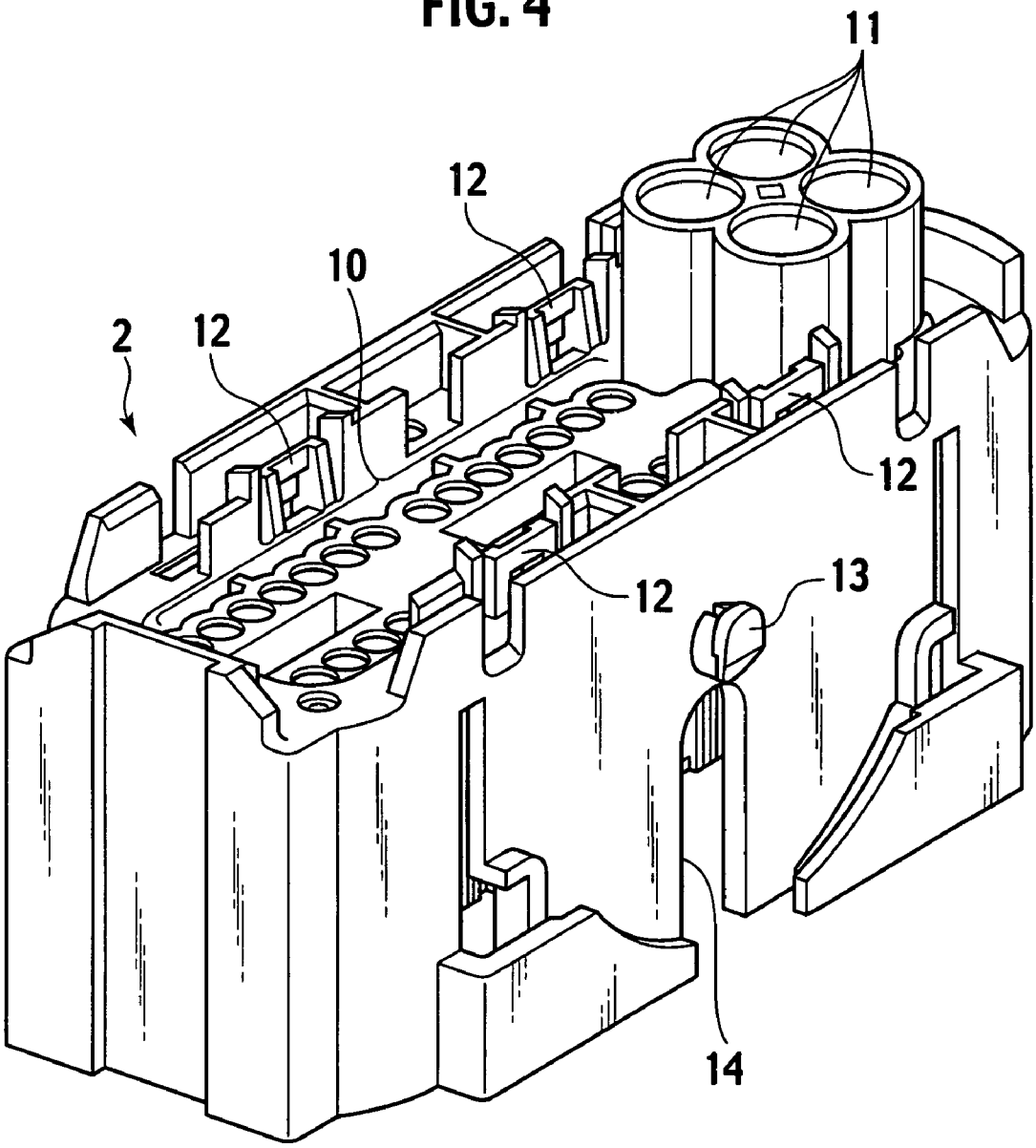
FIG. 4 is a perspective view of a connector housing according to the embodiment.
Figure 5:
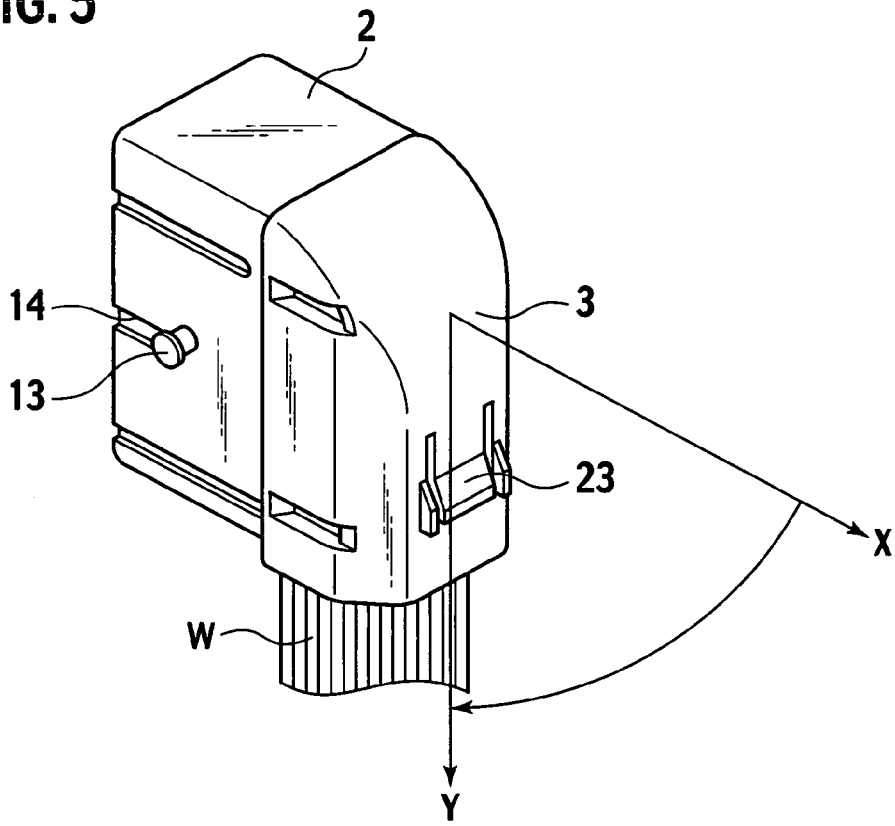
FIG. 5 is a perspective view of a state where a cover is mounted on the connector housing according to the embodiment.

An embodiment of the present invention will be explained below with reference to the accompanying drawings. As shown in FIGS. 3 to 5, a lever type connector 1 includes a connector housing 2 made of a synthetic resin to which a terminal (not shown) having electric wires W is attached, a cover 3 made of a synthetic resin that is mounted on the connector housing 2, and a lever 4 made of a synthetic resin that is rotatably mounted on the connector housing 2. In order to converge directions of the electric wires W that are led out toward the cover from cavities 10 and 11 of the connector housing 2 in a direction Y of 0 to 90 degrees with respect to a leading out direction X of the electric wires W, the cover 3 accommodates the electric wires therein and leads out the same as a batch of electric wires.

The connector housing 2 has a rectangular parallelepiped configuration, and has the cavities 10 and 11 at its upper surface. The terminal having the electric wires W is attached in the cavities 10 and 11. Cover snap gates 12 project from left and right outer sides of the cavities 10 and 11. A mounting portion of a partner connector (not shown) is formed on the connector housing 2 on the opposite side from the cavities 10 and 11. The partner connector is attached to the connector housing 2 from the direction of the arrow A in FIG. 3. Rotation pins 13 project from both side surfaces of the connector housing 2, and cam pin insertion grooves 14 are formed in the side surfaces of the connector housing 2.

The cover 3 has a substantially domical shape, and is disposed to cover the cavities 10 and 11 of the connector housing 2. Locking detents 20 are formed on an inner surface of the cover 3. The locking detents 20 engage with the cover snap gates 12 of the connector housing 2 respectively. An opening 21 is formed in one end of the domical cover 3, and the electric wires W are let out from the opening 21. A snap tab 23 is provided on a substantially domical ceiling of the cover 3.

Figure 7A:
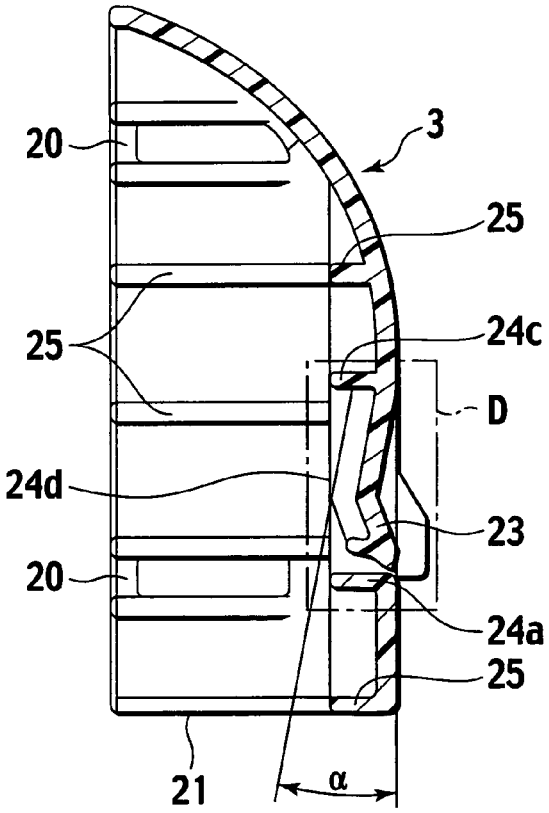
FIG. 7A is a sectional view of the cover according to the embodiment showing a bending state of a snap tab.
Figure 7B:
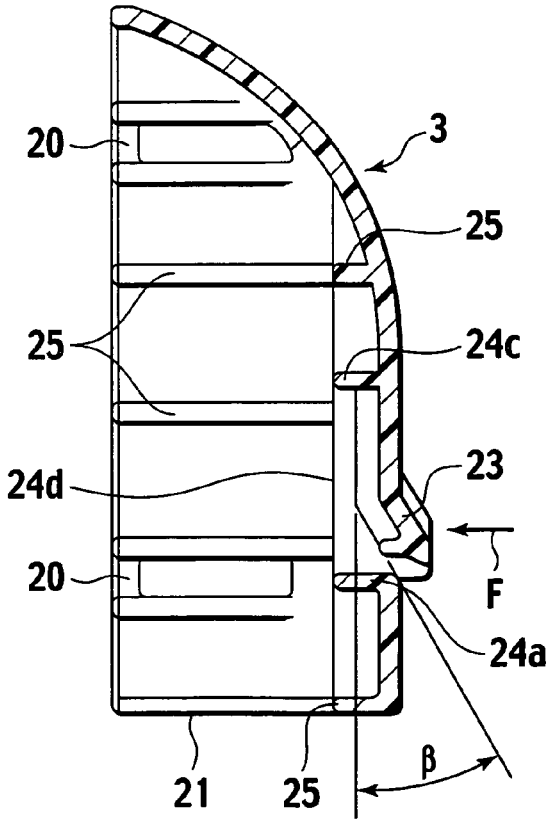
FIG. 7B is a sectional view of the cover according to the embodiment showing a restored state of the snap tab.

The snap tab 23 is integrally formed on the cover 3 by a U-shaped slit 3*a*. As shown in FIG. 7B, a fixed side of the snap tab 23 extends in a surface direction, and the free end side is folded toward an outer side of the cover 3. As a result, the snap tab 23 is cantilevered and its whole bent shape has an obtuse angle. Since the snap tab 23 is cantilevered, if a downward pressing force F acts on the snap tab 23, the snap tab 23 is bent inward of the cover 3 as shown in FIG. 7A.

Since the snap tab 23 has the bent shape with an obtuse angle, the maximum bent angle α (shown in FIG. 7A) of the snap tab 23 bent toward the inner side of the cover 3 is set to be smaller than an inclination angle β (shown in FIG. 7B) of the snap tab 23 toward the outer side of the cover 3 when the snap tab 23 is not bent. That is, a projecting stroke amount of the snap tab 23 bent toward the inner side is suppressed to be smaller than a pressing stroke amount required for bending the snap tab 23. In this embodiment, the snap tab 23 is bent to its maximum bent state when the free end thereof projecting from the outer surface of the cover 3 is pushed to the same level as the outer surface of the cover 3.

Figure 6:
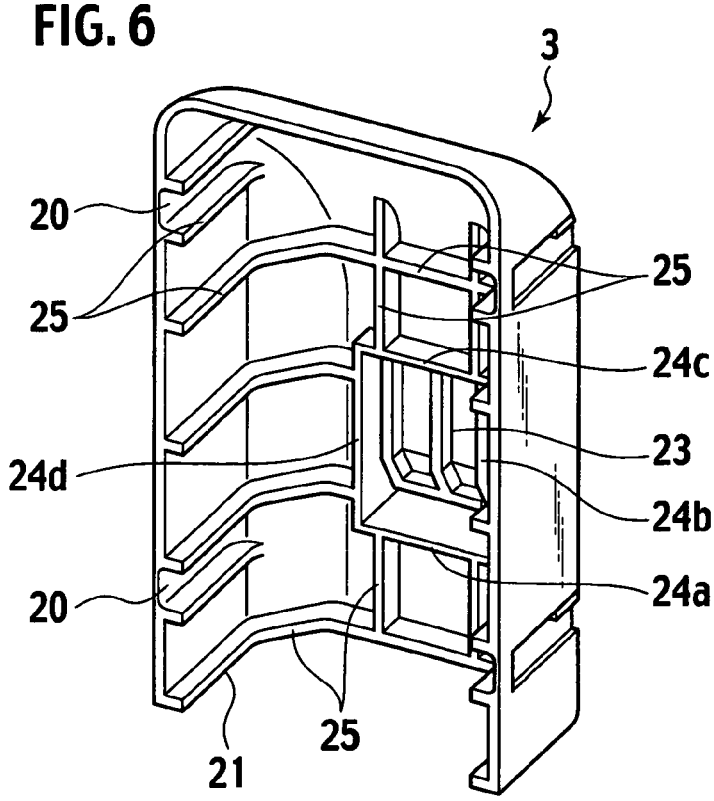
FIG. 6 is a perspective view of the cover according to the embodiment as viewed from an inner surface.
Figure 8:
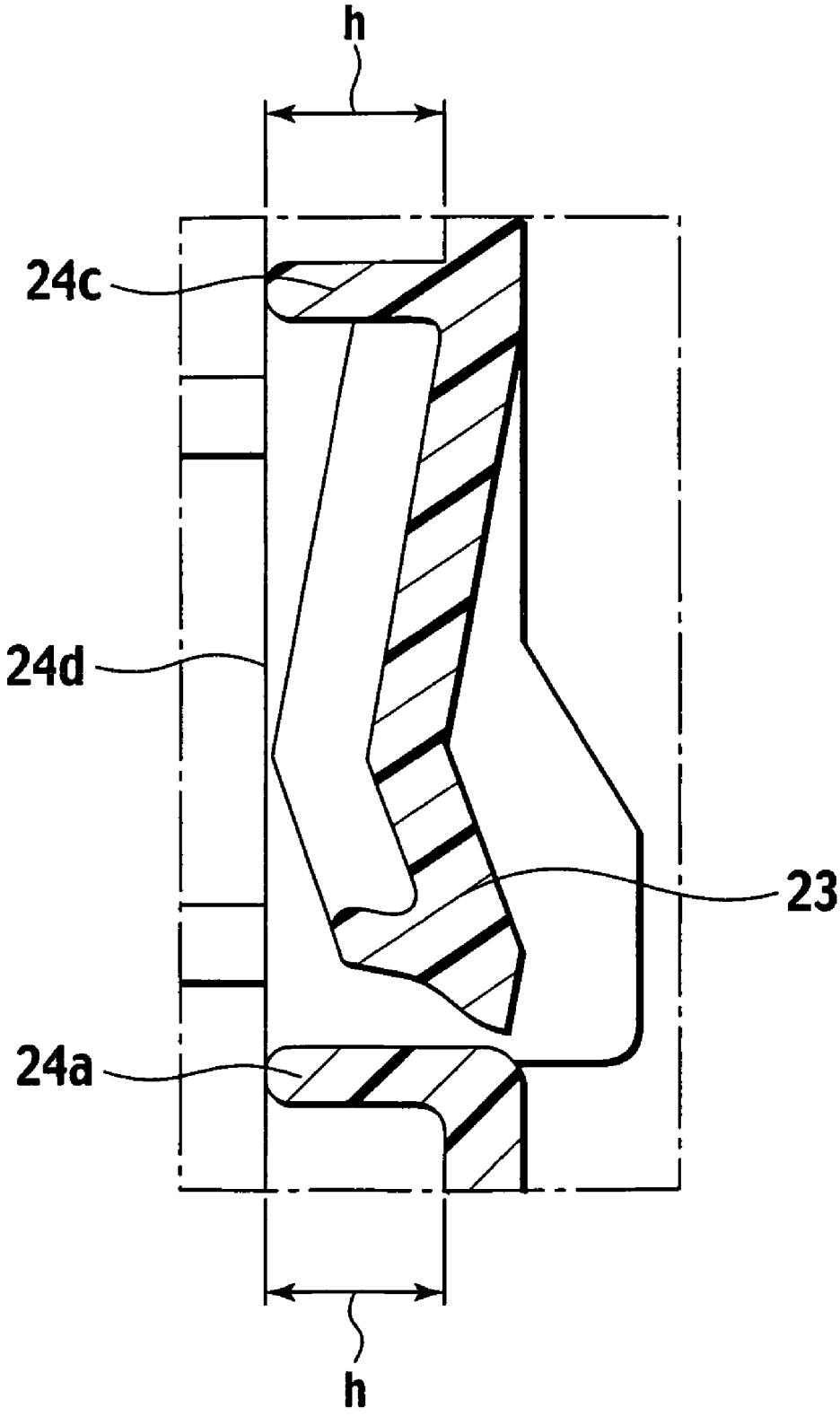
FIG. 8 is an enlarged view of a portion D in FIG. 7A.

As shown in FIG. 6, reinforcing ribs 24*a*, 24*b*, 24*c* and 24*d* project from the inner surface of the cover 3 near the snap tab 23. The reinforcing ribs 24*a*, 24*b*, 24*c* and 24*d* are disposed in a form of a rectangular frame to surround all of four corners of the snap tab 23. As shown in FIG. 8, the height h of each of the reinforcing ribs 24*a*, 24*b*, 24*c* and 24*d* is set to be higher than a maximum inward projection amount of the snap tab 23 so that the electric wires W accommodated in the cover 3 are prevented from entering the bending region of the snap tab 23.

As shown in FIG. 6, other reinforcing ribs 25 project from the inner surface of the cover 3 at positions other than near the snap tab 23. The reinforcing ribs 24*a*, 24*b*, 24*c*and 24*d* and the other reinforcing ribs 25 are formed into a lattice structure as a whole. The height of the reinforcing rib 25 is the same as the heights h of the reinforcing ribs 24*a*, 24*b*, 24*c* and 24*d*.

As shown in FIG. 3, the lever 4 includes a pair of left and right arms 40, and a connecting portion 41 that connects the pair of arms 40. Each arm 40 is formed with a rotation hole 42. And the rotation pins 13 of the connector housing 2 are inserted into the rotation holes 42 respectively. The lever 4 is mounted on the connector housing 2 so that the lever 4 can rotate around the pair of rotation pins 13 between the unlocking position (the position in FIG. 3) and the locking position. Each arm 40 is formed with a cam groove 43 whose distance from the rotation hole 42 is changed along a circumferential direction.

The fitting operation of the partner connector (not shown) will be explained. First, the operator inserts the cam pins (not shown) of the partner connector into the cam pin insertion grooves 14 of the connector housing 2 respectively, and inserts the partner connector into the connector housing 2 from the direction of the arrow A. The cam pins of the partner connector inserted into the connector housing 2 are engaged with the cam grooves 43 of the lever 4 respectively, and the partner connector is set in the half-fitted position with respect to the connector housing 2.

If the lever 4 located in the unlocking position is rotated in the direction of the arrow B, the cam pins receive pressing forces by the cam grooves 43 in accordance with rotation of the lever 4. The partner connector is gradually displaced to the full-fitted position of the connector housing 2 by this pressing force. If the rotation position of the lever 4 reaches a location just before the locking position, the connecting portion 41 of the lever 4 pushes the snap tab 23 of the cover 3, and the snap tab 23 is bent inward of the cover 3 as shown in FIG. 7A. Consequently, the lever 4 can further rotate. If the lever 4 is rotated to the locking position in this state, the partner connector is pulled in to the full-fitted position by the cam grooves 43 and the cam pins. If the lever 4 reaches the locking position, the lever 4 does not push the snap tab 23 any more, the snap tab 23 returns outward of the cover 3 as shown in FIG. 7B, the snap tab 23 engages with the connecting portion 41 of the lever 4 to lock the lever 4.

The releasing operation of the partner connector will be explained. First, if the operator pushes down the snap tab 23 and rotates the lever 4 in the locking position to the unlocking position, the partner connector is separated from the full-fitted position to the half-fitted position by the cam grooves 43 and the cam pins. If the operator separates the partner connector in the half-fitted position from the connector housing 2, the releasing operation of the partner connector is completed.

In the lever type connector 1, the maximum bent angle α of the snap tab 23 bent inward of the cover 3 is set to be smaller than the inclination angle β outward of the cover 3 when the snap tab 23 of the cover 3 is not bent. Therefore, the projecting stroke inward of the cover 3 of the snap tab 23 can be made smaller than the pressing stroke for bending the snap tab 23. Thus, when the snap tab 23 is bent, the projecting amount of the snap tab 23 inward of the cover 3 can be suppressed, and it is possible to prevent the snap tab 23 and the electric wires W from contacting with each other. As a result, even when a filling ratio of the electric wires W into the cover near the locking portion is high, it is possible to prevent the cover from coming into contact with the electric wires W, and it is possible to prevent the electric wires W from being damaged by the pressing force, and to avoid the operation failure of the snap tab 23.

In this embodiment, the reinforcing ribs 24*a*, 24*b*, 24*c* and 24*d* that prevent the electric wires W from entering the bending region of the snap tab 23 project from the inner surface of the cover 3 near the snap tab 23. Since the electric wires W in the cover 3 do not enter the bending range of the snap tab 23 by the reinforcing ribs 24*a*, 24*b*, 24*c* and 24*d*, it is possible to reliably prevent the snap tab 23 and the electric wires W from contacting with each other.

The reinforcing ribs 24*a*, 24*b*, 24*c* and 24*d* are formed to surround the entire periphery of the snap tab 23 and protect the entire outer periphery of the locking portion. Thus, it is possible to substantially completely prevent the electric wires W and the snap tab 23 from contacting with each other. The thickness of the fixed side of the snap tab 23 can be adjusted in the range from the thickness of the cover 3 to the height of the reinforcing rib (protection wall) 24*c*. Thus, the flexibility for forming the snap tab is enhanced. When the slit 3*a* is formed in the cover 3 to form the snap tab 23 integrally as in the embodiment, it is possible to prevent a crack from being generated toward the periphery of the slit 3*a* by the reinforcing ribs 24*a*, 24*b*, 24*c* and 24*d*. If the snap tab 23 is formed by the slit 3*a*, a surface of the cover 3 is opened and the strength of the cover 3 is lowered, but the deterioration of the strength can be suppressed by the reinforcing ribs 24*a*, 24*b*, 24*c* and 24*d*.

Further, since the other reinforcing ribs 25 project from the inner surface of the cover 3 at positions other than near the snap tab 23, the strength of the cover 3 is enhanced. Consequently, it is possible to reliably prevent the cover 3 from being deformed when the snap tab 23 is bent, and the thickness of the side surface of the cover 3 can be thinned. It is possible to assist the convergence of the electric wires W by the other reinforcing ribs 25.

Further, the reinforcing ribs 24*a*, 24*b*, 24*c* and 24*d* and the other reinforcing ribs 25 are formed into a lattice structure as a whole. As a result, the reinforcing ribs in the lateral direction and the reinforcing ribs in the vertical direction mutually prevent deforming, and rigidity against twisting of the cover 3 is enhanced.

In this embodiment, the heights h of the reinforcing ribs 24*a*, 24*b*, 24*c* and 24*d* surrounding the entire periphery of the snap tab 23 are set to be higher than the inward projection amount of the snap tab 23 bent to a maximum extent. Thus, it is only necessary to set the height h to be higher than at least the inward projection amount of the snap tab 23 bent to a maximum extent.

What is claimed is:

1. A lever type connector comprising:

a connector housing to which a terminal having electric wires is attached;

a cover that is mounted on the connector housing to accommodate the electric wires by a given range and lead the electric wires outside;

a lever that is mounted on the connector housing to be rotatable between an unlocking position and a locking position; and a snap tab provided on the cover, wherein if the lever is rotated from the unlocking position to the locking position in a state where the partner connector is half-fitted into the connector housing, the partner connector is forcibly displaced from a half-fitted position to a full-fitted position, the snap tab is pressed by the lever and bent inward of the cover during rotation of the lever from the unlocking position to the locking position so that the lever can rotate, and if the lever reaches the locking position, the snap tab is returned to lock the lever, and a maximum bent angle of the snap tab bent inward of the cover is set to be smaller than an inclination angle outward of the cover when the snap tab is not bent;

wherein a reinforcing rib that prevents the electric wires from entering a bending region of the snap tab projects from an inner surface of the cover in the vicinity of the snap tab.

2. The lever type connector according to claim 1, wherein the reinforcing rib is formed to surround the entire periphery of the snap tab.

3. A lever type connector comprising:

a connector housing to which a terminal having electric wires is attached;

a cover that is mounted on the connector housing to accommodate the electric wires by a given range and lead the electric wires outside;

a lever that is mounted on the connector housing to be rotatable between an unlocking position and a locking position; and a snap tab provided on the cover, wherein if the lever is rotated from the unlocking position to the locking position in a state where the partner connector is half-fitted into the connector housing, the partner connector is forcibly displaced from a half-fitted position to a full-fitted position, the snap tab is pressed by the lever and bent inward of the cover during rotation of the lever from the unlocking position to the locking position so that the lever can rotate, and if the lever reaches the locking position, the snap tab is returned to lock the lever, and a reinforcing rib that prevents the electric wires from entering a bending region of the snap tab projects from an inner surface of the cover in the vicinity of the snap tab, and other reinforcing rib projects from the inner surface of the cover at a position other than the periphery of the snap tab.

4. The lever type connector according to claim 3, wherein each reinforcing rib is provided in a form of a lattice.

5. The lever type connector according to claim 3, wherein the reinforcing rib other than the other reinforcing rib is formed to surround the entire periphery of the snap tab.

* * * * *